United States Patent [19]

Schmalz

[11] Patent Number: 5,045,387

[45] Date of Patent: Sep. 3, 1991

[54] REWETTABLE POLYOLEFIN FIBER AND CORRESPONDING NONWOVENS

[75] Inventor: A. Chandler Schmalz, Conyers, Ga.

[73] Assignee: Hercules Incorporated, Wilmington, Del.

[21] Appl. No.: 386,316

[22] Filed: Jul. 28, 1989

[51] Int. Cl.[5] ..... B32B 27/00

[52] U.S. Cl. ..... 428/284; 428/286; 428/288; 428/289; 428/270; 428/375; 428/391; 428/374; 428/447; 428/448

[58] Field of Search ..... 428/284, 286, 288, 289, 428/290, 375, 391, 394, 447, 448

[56] References Cited

U.S. PATENT DOCUMENTS

| | | | |
|---|---|---|---|
| 3,426,754 | 2/1969 | Bierenbaum et al. | 428/315.5 |
| 3,853,601 | 12/1974 | Taskler | 117/98 |
| 3,922,462 | 11/1975 | Katz et al. | 428/290 |
| 3,929,509 | 12/1975 | Taskler | 136/146 |
| 3,968,317 | 7/1976 | Dumas | 428/514 |
| 3,975,348 | 8/1976 | Christena | 523/523 |
| 4,303,456 | 12/1981 | Schmuck et al. | 428/290 |
| 4,312,914 | 1/1982 | Guth | 428/290 |
| 4,361,611 | 11/1982 | Schäfer | 428/96 |
| 4,447,570 | 5/1984 | Cook et al. | 428/288 |
| 4,504,541 | 3/1985 | Yasuda et al. | 428/290 |
| 4,536,446 | 8/1985 | Hsu et al. | 428/375 |
| 4,578,414 | 3/1986 | Sawyer et al. | 524/375 |
| 4,668,406 | 5/1987 | Chang | 428/289 |
| 4,680,203 | 7/1987 | Maki et al. | 427/393.6 |
| 4,721,655 | 1/1988 | Trzasko et al. | 428/530 |
| 4,743,470 | 5/1988 | Nachtkamp et al. | 428/290 |
| 4,764,418 | 8/1988 | Kuenn et al. | 428/284 |
| 4,828,911 | 5/1989 | Morman | 428/288 |
| 4,885,204 | 12/1989 | Bither et al. | 428/286 |
| 4,904,522 | 2/1990 | Markusch | 428/288 |

FOREIGN PATENT DOCUMENTS

| | | |
|---|---|---|
| 0325543 | 7/1989 | European Pat. Off. . |
| 0117562 | 7/1982 | Japan . |
| 0265915 | 11/1988 | Japan . |

*Primary Examiner*—George F. Lesmes
*Assistant Examiner*—Beverly A. Pawlikowski
*Attorney, Agent, or Firm*—John E. Crowe

[57] ABSTRACT

A method for imparting and retaining hydrophilicity and liquid strike-through properties within an essentially hydrophobic polyolefin-containing nonwoven material and the corresponding fiber, fibrillated film, and nonwoven product thereof, whereby essentially hydrophobic polyolefin-containing fiber or film is topically treated with an effective amount of one or more of a water soluble polyalkoxylated polydimethylsiloxane, an alkoxylated ricinolein with certain fatty acids, or corresponding hydrogenated derivatives thereof.

17 Claims, No Drawings

REWETTABLE POLYOLEFIN FIBER AND CORRESPONDING NONWOVENS

The present invention relates to a method for imparting sustainable hydrophilic properties to essentially hydrophobic polyolefin-containing fiber, fibrillated film, webs thereof and corresponding nonwoven material, by topically applying a defined modifier composition.

BACKGROUND

While the manufacture and various uses of polyolefin-based fiber, webs and corresponding nonwoven materials are well known in the textile art, attempts to broadly apply such knowledge to produce products in the area of personal hygiene, such as cover stocks for catamenial devices, disposable diapers, incontinence pads and the like, have met with somewhat limited success.

In general, such products must have a fluid-absorbent core, usually comprising one or more layers of absorbent material such as wood pulp, rayon, gauze, tissue or the like, and, in some cases, synthetic hydrophilic material such as a polyurethane foam.

The fluid-absorbing product is generally provided in the form of a thermally bonded pad, of wood pulp, fiber and/or conjugate fiber, which may have a rectangular or somewhat oval shape. To protect clothing, and surrounding areas from being stained or wetted by fluids absorbed in the pad, it is generally backed by a fluid-impervious barrier sheet.

To enhance a sense of comfort, such absorbent core generally also has a facing of cover stock material which masks at least the body-facing surface of the product. The purpose of this cover is two-fold, namely (1) to help to structurally contain the loosely packed core of absorbent material and (2) to protect the wearer from continuous direct contact with moisture from previously wetted absorbent material. The facing or cover stock must, therefore, be pervious to fluids on the side of the product that is placed against the body, actively promoting the immediate transfer of each fluid application or insult directly into the absorbent core, and yet itself be essentially nonabsorbent. It is also necessary to minimize lateral migration of fluid along the cover stock surface even after repeated insults, and for the surface to continue to feel smooth and soft to the touch. Certain additional characteristics are also sometimes desired, such as visual opacity plus specific coloring or luster on the outer surfaces and the acceptance of designs.

In order to obtain many of the above-listed characteristics, however, it is imperative that cover stocks utilizing essentially hydrophobic polymeric material such as polyolefins, be made relatively hydrophilic and have the above-noted continuing ability to pass aqueous fluids through to an absorbent core, even after several insults (i.e. wettings) without wash out or leach out of hydrophilic-promoting agents. This is particularly important, in the case of diaper cover stock, to avoid lateral liquid migration and side leakage, and to minimize any interference with fabric bonding steps which would cause a reduction in wet strength of the final product.

Based on prior teaching in the paper-making art, it is known that short term hydrophilicity can be imparted to essentially hydrophobic polymers such as polyolefin fiber by using flash evaporation techniques and treating the resulting fiber or filament with hydrophilizing agents such as polyvinyl alcohol or various nitrogen-containing water-soluble polymers (ref. U.S. Pat. Nos. 4,156,628, 4,035,229, 4,082,730, 4,154,647, 4,156,628, 4,035,229, 4,273,892 and 4,578,414).

For personal hygiene purposes, however, a general lack of resistance to wash out among most art-recognized hydrophilic-promoting additives, plus interference with web-bonding properties justifies continuing efforts to improve long term hydrophilicity. Such efforts have, more recently included incorporating alkoxylated alkylphenols or corresponding polyoxyalkylenes into spun melt compositions (ref. U.S. Pat. No. 4,578,414). Serious high speed spinning, bonding, and fluid retention problems remain, however.

It is an object of the present invention to more effectively utilize inert hydrophobic polyolefin-containing nonwoven materials in the area of personal hygiene.

It is a further object of the present invention to efficiently utilize polyolefin-containing webs comprised of one or more of fiber, and fibrillated film within cover stock.

It is a still further object to obtain and retain hydrophilicity and liquid strike through properties in strong well bonded nonwoven hydrophobic materials utilizing polyolefin component.

THE INVENTION

It is now found that acceptable hydrophilicity and liquid pass through properties of nonwoven materials, particularly those comprised of essentially hydrophobic polyolefin-containing web(s) of fiber and fibrillated film, or combination thereof can be obtained and retained for an extended period by applying an effective amount, inclusive of about 0.5%–2% by web weight, of a modifier composition comprising at least one of (a) a component containing alkoxylated ricinolein with up to about 15%, by weight of modifier composition, of an 18 carbon fatty acid;

(b) a corresponding hydrogenated derivative of component (a); and (c) a polyalkoxylated polydimethylsiloxane having up to about 80% by weight of modifier composition, of one or more of component (a) (b) or combination thereof carding and forming webs in a conventional manner from corresponding composition-treated polyolefin-containing staple fiber, fibrillated film, or combination thereof and bonding one or more of said webs in an art-recognized manner, to obtain a desired nonwoven material.

The above-described modifier composition components are further conveniently described in formula form as at least one alkoxylated compound within the formula.

A.

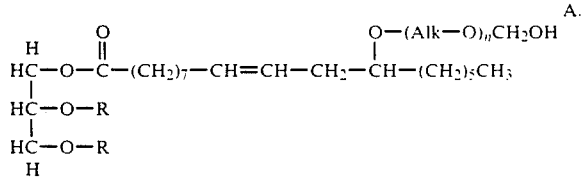

combined with up to about 15%, by weight of modifier composition, of at least one fatty acid selected from oleic, linoleic, stearic and palmitic acid; and/or

B.

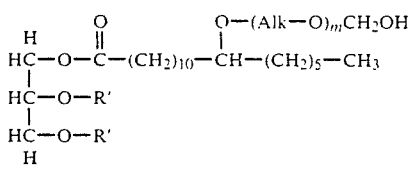

combined with up to about 15%, by weight of modifier composition, of at least one fatty acid selected from stearic acid and oleic acid; wherein R is individually defined as an acyl derivative of ricinoleic acid;

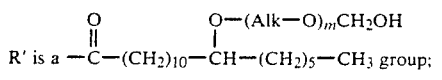

Alk is a methylene chain of 2-4 carbon atoms and preferably a $-CH_2CH_2$-group; and n and m are individually defined as a positive number of about 1-10.

Included within the above-defined modifier composition are components such as an ethoxylate of ricinolein (i.e. an ethoxylated glyceride of a major castor oil component) and/or a water soluble ethoxylate of polydimethylsiloxane, an example of the latter being commercially obtainable from Union Carbide Corporation as a product identified as "Y-12230".

Also of interest, for purposes of the present invention, are mixtures of Y-12230 with about 0.5%-80%, by weight of modifier composition, of an ethoxylate of ricinolein in combination with about 7% to 10%, by weight of oleic and/or linoleic acid, or 7% to 10%, by weight of corresponding saturated 18 carbon fatty acid(s), such as stearic and palmitic acid. Castor oil is found to provide a convenient source for the above-required precursors, which can be conventionally alkoxylated and hydrogenated to obtain the "(b)" and "(c)" components as above defined.

For present purposes the term "effective amount" as here utilized is construed as falling within a range of about 0.2% to about 2% based on fiber, film or combined weight and preferably about 0.5%-1% by weight.

Also useful, for present purposes, is the inclusion of about 0.1%-0.3% by wt. of an antistat agent or spin finish such as a neutralized phosphoric acid alcohol ester obtainable commercially as Lurol AS-Y (a product of G. A. Goulston Company), particularly in combination with the above-defined "(c)" component.

Continuous spun fiber or filaments used to form webs preferably comprise topically treated staple fiber or filament of bicomponent or monofilament types, or fibrillated film, which can be conventionally drawn over a feed or kiss roll partially immersed in a bath of the above-defined modifier composition, dipped therein, or sprayed in effective amount for fiber processing, and dried.

The fiber of films used to form webs and nonwovens, as described, are preferably spun or cast from isotactic polypropylene, art-recognized hydrophobic copolymers or mixtures thereof, the spin melt conveniently having a weight average varying from about $3\times10^5$ to about $5\times10^5$, a molecular weight distribution of about 5.0-8.0, a melt flow rate of about 2.5 to about 4.0 g/10 min., plus a spin temperature conveniently within a range of about 220° C.-300° C.

For present purposes, the above-defined modifier composition is best applied topically in liquid commercially obtainable form, for instance, as Dacospin® 1735A, Stantex® A-241(*1) and/or Y-12230*2. The above parameters can be modified, if necessary, to favor particularly desired characteristics such as increased wet strength or softness, adaptability for high speed production of the fiber or fabric and the like.

*1 Commercial products of Henkel A. G. *2 A commercial product of Union Carbide.

For present purposes, webs used to form nonwovens within the scope of the present invention can be conventionally formed by utilizing melt blown, spun bonded or a Dry carded process using cut staple fiber bonded together using usual art-known bonding techniques, inclusive of adhesive binders (U.S. Pat. No. 4,535,013), heated calender rolls, hot air, sonic, laser, pressure bonding, needle punch, and the like.

Hydrophilic-induced fiber and webs used to fabricate nonwoven material, such as cover stock, can also usefully comprise conventional sheath/core or side-by-side bicomponent fiber or filament, alone or combined with treated or untreated homogenous-type fiber or filament and/or fibrillated film.

Also within the scope of the present invention is the use of nonwovens comprised of one or more bonded webs of modifier-treated polyolefin fiber- and/or fiber-like (fibrillated film) components having a mixed fiber denier of homogeneous and/or bicomponent types, generally not exceeding about 40 dpf. Such webs preferably utilize fiber or filaments within a range of about 0.1-40.0 dpf.

In addition, the resulting nonwoven material can be embossed and/or calender printed conventionally with various designs and colors, as desired, to increase loft, augment wet strength, and provide easy market identification.

Further includible within the instant invention are fibers utilizing art-recognized additives conventionally incorporated in the spin melt or topically applied, including pH stabilizers such as calcium stearate, antioxidants, degrading agents, pigments, including whiteners and colorants such as $TiO_2$ and the like. Generally such additives can individually vary, in amount, from about 0.1%-3% by weight of spin melt.

In addition, webs used in forming nonwovens within the scope of the present invention are generally produced from one or more types of conventionally spun fibers or filaments having, for instance, round, delta, trilobal, or diamond cross sectional configurations.

Nonwoven cover stock of the above-defined types can usefully vary in weight from about 10-45 gm $yd^2$ or higher.

The invention is further illustrated, but not limited, by the following Example and Tables:

EXAMPLE 1

A. Two batches of isotactic polypropylene are fed through a 1½" extruder and conventionally spun, using a 210 hole spinnerette at 285° C., air quenched, and resulting continuous 2.5 dpf and 3.0 dpf batch filaments passed over a feed or kiss roll partly immersed in a tank of modifier composition comprising ethoxylated poly dimethyl siloxane (obtained commercially from Union Carbide as "Y-12230") together with about 1% by weight of Lurol AS-Y, a neutralized phosphoric acid-/alcohol ester as an antistat agent (obtained commercially from G. A. Goulston Incorporated); two batches are prepared varying in duration and speed so as to topically apply 0.87 wt. % and 0.36 wt. % of the modifier composition respectively. The resulting spin yarn is drawn, passed through a crimper, topically treated with finish, chopped to 1.5" staple, then carded into webs weighing about 20 g/yd$^2$, and routinely calendar bonded at 165° C. to obtain test nonwoven materials. The respective test nonwovens are cut into test strips identified as S-1, S-2 and S-3 for conventional strike through and rewet tests using Syn-urine (*3) as the wetting fluid. Test results are reported in Table I below.

An average of several 2.5 dpf control samples (C-1) are identically prepared, except for the absence of topically applied modifier composition, and the corresponding non-woven tested and reported in Table I.

(*3) Syn-urine is obtained commercially from Joyce Pharmaceutical Company of Camp Hill, Penn.

TABLE I

| | | THERMAL BONDED FABRIC TOPICAL TREATMENT | | | | |
|---|---|---|---|---|---|---|
| Samples | Denier (dpf) | Finish | Level | Insults | Strike-Through Rewet Time (Sec) | Rewets |
| S-1 | 2.5 | Y-12230/0.5% ASY | 0.87% | 1 | 1.2 | 0.11 |
| | | | 0.87% | 2 | 1.1 | 0.10 |
| | | | 0.87% | 3 | 1.2 | 0.10 |
| | | | 0.87% | 4 | 1.8 | 0.11 |
| | | | 0.87% | 5 | 2.4 | 0.11 |
| S-2 | 3.0 | Y-12230/0.5% ASY | 0.36% | 1 | 1.0 (*4) | 0.11 |
| | | | 0.36% | 2 | 178.5 | 0.11 |
| | | | 0.36% | 3 | 56.3 | 0.11 |
| | | | 0.36% | 4 | 108.3 | 0.11 |
| | | | 0.36% | 5 | 15.4 | 0.10 |
| S-3 | 2.5 | Y-12230/0.5% ASY | .34 | 1 | 1.3 | .16 |
| | | | .34 | 2 | 21.8 | .13 |
| | | | .34 | 3 | 20.3 | .13 |
| | | | .34 | 4 | 28.1 | .13 |
| | | | .34 | 5 | 152.4 | .12 |
| C-1 | 2.5 | No Modifier | 0 | 1 | 1.6 | .10 |
| | | No Modifier | 0 | 2 | 300 | .10 |

(*4) Inconsistent results believed due to contaminated spin lubricant

B. 3 dpf spun fiber is conventionally prepared by batch, using polypropylene fiber and a spinning device as described in Example IA, to which 1. 50% Y12230/50% Silwet® 7603, or
2. Dacospin® and 1735A, or
3. Stantex® A241 are respectively topically applied using a kiss wheel, and the treated fiber air dried as before. Five (5) gram samples of 1.5 inch uncrimped staple fiber from each batch are loosely packed into identical 3 gram mesh baskets for sink-time tests in accordance with ASTM Method D-1117-79, whereby an increase in sink time (i.e., increase in time of submergence) after repeated insults by Syn-urine(*3) is interpreted as the result of a wash out or leach out applied of wetting agent and corresponding loss in desired hydrophilic properties. Test results are reported in Table 2 as Samples S-4, S-5, and S-6 and the corresponding control, having 5 gm of the spun polypropylene without modified composition, is reported as C-3 in Table 2.

TABLE 2

| | | REWETTABLE POLYPROPYLENE SPIN YARN TOPICAL TREATMENT | | | |
|---|---|---|---|---|---|
| Samples | Fiber (dpf) | Type Finish | Modifier Composition | Insults | Sink Time (Sec) |
| S-4 | 3.0 | 50% Y12230 50% Silwet 7603 | 2.0% | 1 | 1 |
| | | | | 2 | 1 |
| | | | | 3 | 3 |
| | | | | 4 | 2 |
| | | | | 5 | 3 |
| S-5 | 3.0 | Dacospin 1735A | 1.0% | 1 | 2 |
| | | | | 2 | 7 |
| | | | | 3 | 10 |
| | | | | 4 | 22 |
| | | | | 5 | 34 |
| S-6 | 3.0 | Stantex A241 | 1.6% | 1 | 2 |
| | | | | 2 | 15 |
| | | | | 3 | 15 |
| | | | | 4 | 14 |
| | | | | 5 | 10 |
| C-3 | 2.5 | — | — | 1 | 1.1 |
| | | | | 2 | 4.0 |
| | | | | 3 | 60.0 |
| | | | | 4 | 600.0 |

What is claimed is:

1. A nonwoven material formed from one or more webs of polyolefin fiber, fibrillated film or combination thereof, having applied thereon an effective amount of a modifier composition comprising at least one of (a) a component containing alkoxylated ricinolein with up to about 15%, by weight of modifier composition, of an 18 carbon fatty acid;

(b) a corresponding hydrogenated derivative of component (a); and (c) a polyalkoxylated polydimethylsiloxane having up to about 80% by weight of modifier composition, of component (a), (b) or combination thereof.

2. The nonwoven material of claim 1, wherein the polyolefin-containing fiber- and/or fibrillated polyolefin-containing film in said webs comprise at least one polypropylene homopolymer or copolymer, and the modifier composition is an ethoxylate of ricinolein in combination with about 7% to 10%, by weight of modifier composition, of oleic and/or linoleic acid.

3. The nonwoven material of claim 1, wherein about 0.5% to 2% modifier composition, by web weight, is topically applied onto the sheath component of a polyolefin sheath/core bicomponent fiber within said webs.

4. The nonwoven material of claim 1, wherein about 0.5% to 2% modifier composition, by web weight, is topically applied onto homogeneous fiber and/or fibrillated film comprising said webs.

5. The nonwoven material of claim 1, wherein said webs comprise polyolefin-containing fiber having a denier range of about 0.1 dpf to about 40 dpf.

6. The nonwoven material of claim 5 comprised of at least one web containing polyolefin fiber having at least one of a delta, trilobal, diamond, or circular cross-sectional configuration.

7. A nonwoven material of claim 1 wherein the fiber, fibrillated film or combination is treated with neutralized phosphoric acid alcohol ester.

8. A polyolefin-containing fiber or fibrillated film having coated thereon an effective amount of a modifier composition comprising at least one of (a) a component containing alkoxylated ricinolein with up to about 15%, by weight of modifier composition, of an 18 carbon fatty acid;

(b) a corresponding hydrogenated derivative of component (a); and (c) a polyalkoxylated polydimethylsiloxane; having up to about 80% by weight of modifier composition, of one or more of component (a), (b), or combination thereof.

9. A fiber or film of claim 17 wherein the modifier composition comprises at least one compound represented by the formula

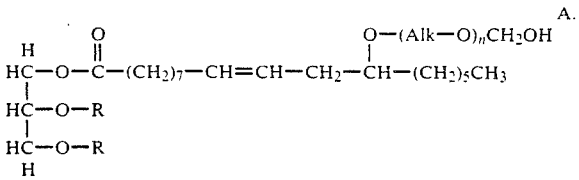

A.

combined with up to about 15%, by weight of modifier composition, of at least one fatty acid selected from the group consisting of oleic, linoleic, stearic and palmitic acid; and/or

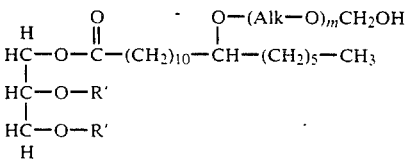

B.

combined with up to about 15% by weight of modifier composition, of a saturated 18 carbon fatty acid; wherein R is individually defined as an acyl derivative of ricinoleic acid;

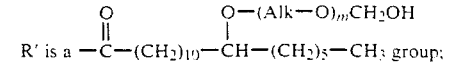

R' is a $-\overset{O}{\overset{\|}{C}}-(CH_2)_{10}-\overset{O-(Alk-O)_m CH_2OH}{\overset{|}{CH}}-(CH_2)_5-CH_3$ group;

Alk is a methylene chain of 2–4 carbon atoms; and n and m are individually defined as a positive number of about 1–10.

10. The fiber or film of claim 17, wherein the modifier composition comprises ethoxylated polydimethylsiloxane in combination with about 0.5%–80%, by weight of modifier composition, of ethoxylated castor oil with an active amount of an antistat agent.

11. The fiber or film of claim 17, wherein about 0.5% to 2% modifier composition, by weight, is topically applied onto the sheath component of polyolefin sheath/core bicomponent fiber.

12. The fiber of claim 8 comprised of at at least one of a delta, trilobal, diamond, or circular cross-sectional configuration.

13. Fiber or fibrillated film of claim 8 wherein fiber or fibrillated film is treated with a neutralized phosphoric acid alcohol ester.

14. A nonwoven material formed from one or more webs of polyolefin-containing fiber, fibrillated film, or combination thereof, having applied thereon an effective amount of a modifier composition comprising at least one of (a) a component containing alkoxylated ricinolein with up to about 15%, by weight of modifier composition, of an 18 carbon fatty acid;

(b) a corresponding hydrogenated derivative of component (a); and (c) a polyalkoxylated polydimethylsiloxane in combination with about 0.5%–80% by weight of component (a), (b) or combination thereof.

15. The nonwoven material of claim 14 wherein the modifier composition comprises at least one compound represented by the formula

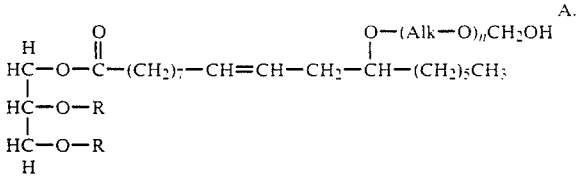

A.

combined with up to about 15%, by weight of modifier composition, of at least one fatty acid selected from the group consisting of oleic, linoleic, stearic and palmitic acid; and/or

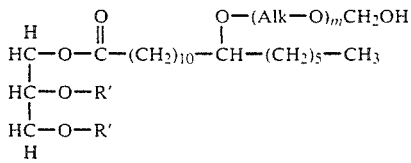

B.

combined with up to about 15%, by weight of modifier composition, of a saturated 18 carbon fatty acid; wherein R is individually defined as an acyl derivative of ricinoleic acid;

R′ is a $-\overset{\overset{\displaystyle O}{\|}}{C}-(CH_2)_{10}-\overset{\overset{\displaystyle O-(Alk-O)_m CH_2OH}{|}}{CH}-(CH_2)_5-CH_3$ group:

Alk is a methylene chain of 2–4 carbon atoms; and n and m are individually defined as a positive number of about 1–10.

16. The nonwoven material of claim 14, wherein the modifier composition comprises ethoxylated polydimethylsiloxane in combination with about 0.5%–80%, by weight of modifier composition, of ethoxylated castor oil with an active amount of an antistat agent.

17. A polyolefin-containing fiber or fibrillated film having coated thereon an effective amount of a modifier composition comprising at least one of (a) a component containing alkoxylated ricinolein with up to about 15%, by weight of modifier composition, of an 18 carbon fatty acid;

(b) a corresponding hydrogenated derivative of component (a); and (c) a polyalkoxylated polydimethylsiloxane in combination with about 0.5%–80%, by weight of component (a), (b) or combination thereof.

* * * * *